US005739740A

United States Patent [19]

Stärk et al.

[11] Patent Number: 5,739,740

[45] Date of Patent: Apr. 14, 1998

[54] SURFACE MOUNTED FUSE WITH END CAPS

[75] Inventors: Klaus Stärk, Witten; André Jöllenbeck, Bochum, both of Germany

[73] Assignee: Wickmann-Werke GmbH, Germany

[21] Appl. No.: 600,928

[22] PCT Filed: Jun. 27, 1995

[86] PCT No.: PCT/EP95/02507

§ 371 Date: Feb. 28, 1996

§ 102(e) Date: Feb. 28, 1996

[87] PCT Pub. No.: WO96/00973

PCT Pub. Date: Jan. 11, 1996

[30] Foreign Application Priority Data

Jun. 29, 1994 [DE] Germany ..... 9410437 U

[51] Int. Cl.[6] ..... H01H 85/143

[52] U.S. Cl. ..... 337/248; 337/227; 337/231; 337/252

[58] Field of Search ..... 337/168, 231, 337/232, 251, 252, 248, 227; 29/623, 854; 228/175, 180.1

[56] References Cited

U.S. PATENT DOCUMENTS

| | | | |
|---|---|---|---|
| 4,540,969 | 9/1985 | Sugar | 337/232 |
| 4,996,509 | 2/1991 | Bernstein | 337/232 |
| 5,166,656 | 11/1992 | Badihi et al. | 337/231 |
| 5,198,792 | 3/1993 | Bacon et al. | 337/297 |
| 5,214,406 | 5/1993 | Reese et al. | 337/251 |

FOREIGN PATENT DOCUMENTS

| | | |
|---|---|---|
| 92 06 792.1 | 8/1992 | Germany . |
| 5-17903 | 3/1993 | Japan . |
| 580759 | 9/1946 | United Kingdom . |
| 2278743 | 7/1994 | United Kingdom . |
| WO 85/01149 | 3/1985 | WIPO . |

*Primary Examiner*—Leo P. Picard
*Assistant Examiner*—Jayprakash N. Gandhi
*Attorney, Agent, or Firm*—Banner & Witcoff, Ltd.

[57] ABSTRACT

An electrical fuse having an insulator, through which a cavity extends from one end to the facing end and which has a cross-sectionally square or rectangular casing part, is further developed in such a way that in the case of easy manufacture a reliable sealing of the cavity openings and a reliable fixing of the fuse element ends, as well as the connections or terminals to the end portions of the insulator are ensured, particularly in such a way that connections projecting over the insulator profile are avoided. For this purpose the insulator has on at least one side an offset end portion of constant cross-section. The fuse is in each case provided with a solder coating at least covering the ends of the end portions, has electrical connections and also a fuse element, which passes through the cavity and whose ends are in each case conductively connected to the electrical connections. There is also a metal coating, which is directly applied in firmly adhering manner at least to the ends of the end portions of the insulator and to which is fixed the solder coating.

15 Claims, 7 Drawing Sheets

SURFACE MOUNTED FUSE WITH END CAPS

BACKGROUND OF THE INVENTION

1. Field of the Invention

The invention relates to a fuse having an insulator, through which extends from one end to a facing end a cavity, in each case a solder coating a least covering the end, electrical connections and a fuse element, which passes through the cavity and whose ends are in each case conductively connected to the electrical connections.

2. Description of the Prior Art

A fuse of the aforementioned type is e.g. known from U.S. Pat. No. 5,214,406 and has a cross-sectionally rectangular insulator, whose offset end portions in each case taper outwards. A cylindrical through bore is positioned coaxially within the insulator, in which is diagonally positioned a fuse element. The ends of the latter are so bent round that it rests on the outer end portion of the insulator. A cap is mounted with solder on each end portion.

During the manufacture of the fuse the cap is pressed onto an end portion, whilst the solder is melted. So that the solder can pass as a connection between the cap and the end portion, there is a gap between the end portion and the cap. However, it is cross-sectionally wedge-shaped and the solder does not adhere to the smooth surface of the end portion, so that when corresponding mechanical stressing occurs the cap can easily be released from the end portion.

It is also known (German utility model 93 13 717.6), for improving the adhesion of solders to insulators of fuses, to provide the end faces of the insulator with a metallization.

SUMMARY OF THE INVENTION

The problem of the present invention is to further develop a fuse, particularly of the type indicated hereinbefore, in such a way that with simple manufacture a reliable closing of the cavity openings and a reliable fixing of the fuse element ends, as well as the connections or terminals to the end portions of the insulator is ensured, more particularly in such a way that connections projecting over the insulator profile are avoided.

In the case of a fuse according to the invention, this problem is solved with the feature combination of claim 1, more particularly in that directly on the end or the entire outer surface of each end portion of the insulator is applied in firmly adhering manner a metal coating to which is fixed the solder coating. Thus, in simple manner in conjunction with a stepping of the end portions with a constant cross-section, it is ensured that the solder coating can be firmly connected to the insulator. The connection between the insulator and solder is so improved that it withstands the higher mechanical stresses, which once again leads to further constructional possibilities which are referred to hereinafter.

In particular if the insulator is made from ceramic or glass according to an embodiment of the invention, a reliable connection between the solder and the insulator is possible without self-closure only in conjunction with the shaping and metal coating according to the invention. In addition, such an insulator is more resistant to heat action than e.g. conventional plastic. With plastic there is also a risk that on disconnecting the fuse, i.e. on interrupting the fuse element at a predetermined current, the resulting arc will damage the insulator. Compared with plastic ceramic or glass has the advantage that it can be better recycled and is less prejudicial to the environment. To give plastic non-flammable properties, it generally contains red phosphorus, which e.g. in the case of a smouldering fire gives off toxic phosphine. However, particularly from the standpoint of the ever stricter environmental standards, this problematical.

Favourable ceramic materials have proved to be alumina ceramic and the less heat conductive magnesium silicate ceramic.

A preferred embodiment has a metal coating or metallization of silver, silver palladium, silver platinum or silver palladium platinum, because these materials can be formed in alloying-resistant manner with respect to the solder. A silver metallization requires a diffusion barrier, which is preferably of nickel.

To ensure easy manufacture, the metal coating is produced by applying and subsequently firing on a metal paste. The metal paste can be of the above-indicated materials such as silver, silver palladium, etc.

As mentioned hereinbefore, due to the metal coating on the insulator a better binding of the solder to the insulator is obtained, so that the solder acquires a greater resistance to detachment from the insulator. It is therefore now possible to exclusively fix the electrical connections to the insulator by means of the solder coating. The solder coating then transfers all the forces acting on the electrical connections to the insulator. Moreover, in simple manner, the cavity can be sealed, in that the solder and/or the electrical connection closes and seals the opening of the cavity on the end face.

According to another embodiment, at least one electrical connection or terminal is cross-sectionally L-shaped, a first wall part being oriented parallel to the end face and the second wall part is perpendicular thereto. For this it is appropriate for the first wall part to be adapted to the contour of the end face of the insulator, which ensures an optimum bearing surface and therefore transmission of forces from the electrical connection to the insulator and vice versa.

Thus, according to this further development of the invention from the wall part of the connection which is fixed by soldering to the metallized end face of the insulator, at least one laterally projecting wall part is bent up or down and applied flat to the corresponding side wall of the insulator.

A wall part bent from the end area and applied to the corresponding side wall leads to an improvement in the fuse connection possibilities. If the end wall of the insulator is metallized in the vicinity of the applied wall part, the latter can also be fixed by soldering after applying solder. It is particularly advantageous to have a connection to a parallele-pipedic insulator with on all four sides bent up wall parts applied to the corresponding side walls of the insulator, which leads to a cross-sectionally rectangular cap.

According to a further development of the invention, the above embodiment can be particularly simply and advantageously produced in that the wall parts to be soldered and bent are initially linked in a multiple blank on which can be mounted a plurality of insulators by means of a device in such a way that the exposed, metallized end faces, accompanied by the interposing of solder coatings, can be placed on the associated wall parts and are solderable therewith, accompanied by the subsequent bending up and application of the further wall parts to the corresponding sides of the insulator.

During manufacture a plurality of insulators prepared by metallization and accompanied the interposing of corresponding solder coatings oriented in a corresponding device, e.g. in a perforated rubber plate is so lowered and engaged on the multiple blank that the subsequently frontal wall parts can be soldered in a single operation. After cutting through the bridges linking the corresponding sheet metal foil parts the wall parts projecting laterally at the particular end of the insulator are bent up until they engage on the corresponding side wall of the insulator and, if desired, are also soldered there. The fuses are then turned round in order to repeat the production of the corresponding connections at the other, still free end faces of the insulator.

The multiple blank appropriately comprises interconnected, cruciform sheet metal foil parts for the case of all-sided, upwardly bendable and applicable wall parts, previously constituting a component of said sheet metal foil parts.

In particular, at least one electrical connection or terminal is in the form of a cap, which is shoved over one end of the insulator. Here again the cap is retained by the solder, whereas in the aforementioned prior art the forces acting on the cap or insulator are in part directly transferred from the cap to the insulator and vice versa. This occurs because the cap engages on the insulator.

The manufacture and the number of parts can, according to a further embodiment, be simplified or reduced in simple manner in that at least one solder coating on one end face of the insulator completely closes the cavity and covers the particular end face and forms the electrical connection.

If the electrical connection is in the form of a cap corresponding to the associated end portion and which is shoved over one end portion of the insulator, the bottom of the cap is preferably thicker than its wall, so as to give greater strength to the connection, without having to accept such a thick wall, which would again give rise to a correspondingly deep stepping of the end portions of the insulator and to a greater material expenditure.

So that a press fit can be obtained between the cap and the end portions of the insulator, the cap wall is preferably inwardly curved at at least one portion with respect to the bottom, but is preferably formed with several, symmetrically distributed, curved portions.

Fundamentally the fuse can be designed as an appliance fuse for various purposes and uses. According to an embodiment of the invention the fuse is constructed as a SM component. The aforementioned simple construction and optimum force transmission via the solder coating are then particularly advantageous.

BRIEF DESCRIPTION OF THE DRAWINGS

Further advantages and features of the invention can be gathered from the following description of embodiments in conjunction with the attached drawings, wherein show.

DETAILED DESCRIPTION OF THE PREFERRED EMBODIMENTS

Figure 1:
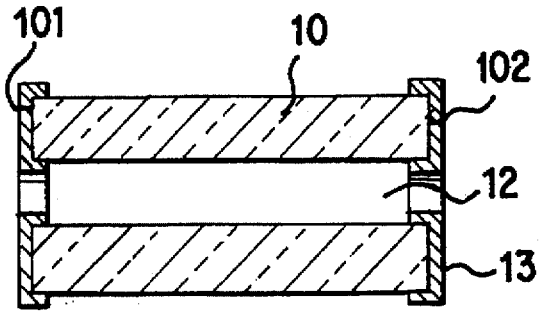
FIG. 1 A longitudinal section through an insulator with in each case a metal coating on its ends.
Figure 2:
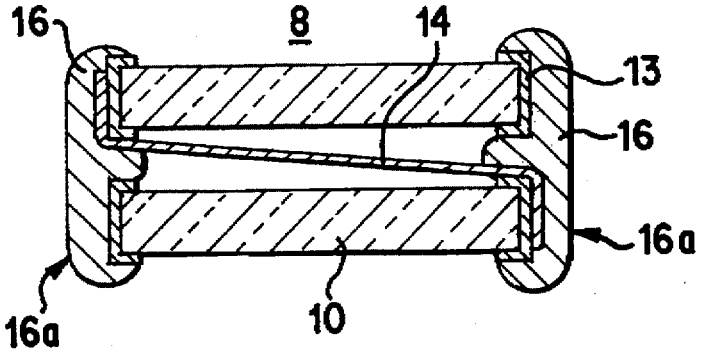
FIG. 2 A longitudinal section through a fuse with the insulator of FIG. 1 according to a first embodiment of the invention.
Figure 3:
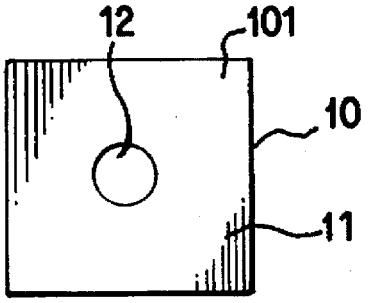
FIG. 3 A front view of the insulator of FIG. 1.

FIG. 1 shows a cross-sectionally rectangular insulator 10 with a cylindrical bore 12. The two ends 101, 102 are metallized, i.e. covered with a metal coating 13. For this purpose a metal paste of silver, silver palladium, silver platinum or silver palladium platinum is applied to the ends 101 and 102, uniformly distributed and then fired on in the furnace. A silver metallization requires a diffusion barrier, which is preferably of nickel. The insulator 10 always has the same construction for the fuses 8 shown in FIGS. 2, 4 and 5. The metallized end 101 of the insulator 10 is shown in FIG. 3.

The insulator 10 comprises alumina ceramic, but can equally well be made of magnesium silicate ceramic or glass. Into the cylindrical bore 12 is introduced a fuse element 14, which passes diagonally and is longer than the bore 12. The fuse element 14 projects out of the bore 12 at both ends 101, 102 of the insulator 10 and into a solder coating 16 applied to said ends 101, 102 and which covers the fuse element ends and closes the bore 12 (cf. FIGS. 2, 4 and 5). By means of the solder coating 16, the ends of the fuse element 14 are secured in the insulator 10. The fuse element 14 is also short-circuited via the solder 16 with electrical connections or terminals.

The fuse element 14 can be both a corrugated fuse element and also a fuse element in the form of an air spiral. However the fuse element 14 can also be wound onto an insulating or a conductive body. It is finally possible to use a fuse element 14 in the form of a strip fuse element.

The electrical connections or terminals can have different constructions. According to a first embodiment shown in FIG. 2, the solder coating 16 on each end 101, 102 of the insulator 10 forms an electrical connection for the fuse 8. For example, the fuse 8 according to FIG. 2 can be directly fixed with its solder coating 16 to a predetermined location on a printed circuit board. For this purpose, it tightly seals the cylindrical bore 12 and fixes and contacts the fuse element 14. Thus, the solder coating 16 forms the electrical connection 16*a*.

Figure 4:
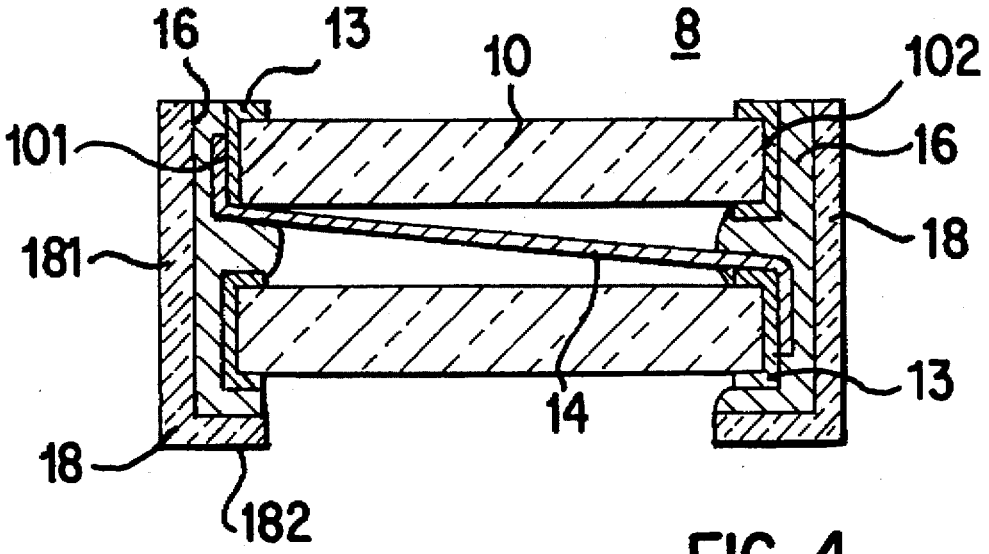
FIG. 4 A longitudinal section through a fuse with the insulator of FIG. 1 in a second embodiment of the invention.
Figure 5:
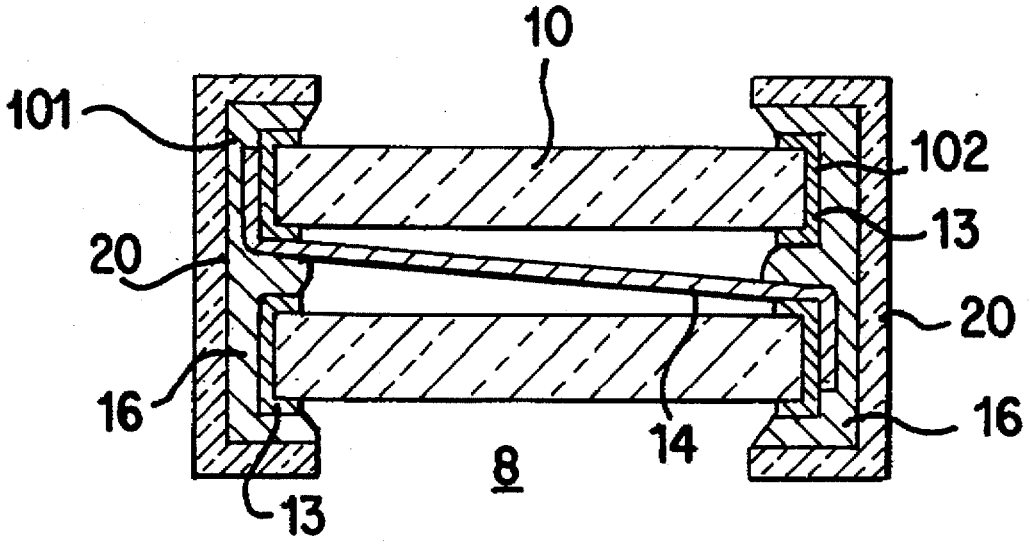
FIG. 5 A longitudinal section through a fuse with the insulator of FIG. 1 in a third embodiment.

According to FIGS. 4 and 5 the solder coating 16 connects an electrical connection 18 or 20, constructed separately from the coating 16, to in each case one end 101, 102 of the insulator 10.

According to FIG. 4 the electrical connection 18 is cross-sectionally L-shaped. A wall part 181 of the electrical connection 18 is adapted to the contour of the end face 101, 102 of the insulator 10 and runs parallel thereto. Between the first wall part 181 of the electrical connection 18 and the end face 101, 102 the solder coating 18 and the metal coating 11 are positioned and, as stated hereinbefore, one end of the fuse element 14 projects into the solder coating 16. The other wall part 182 of the electrical connection 18 runs substantially perpendicular to the end 101 of the insulator 10.

In another embodiment shown in FIG. 5, the electrical connections 20 are constructed as caps 20. The caps 20 are shoved onto the ends of the insulator 10 and between the cap 20 and the insulator 10 is located the solder coating 16 bound to the metal coating 13.

Figure 6A:
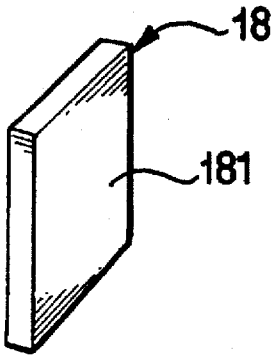
FIGS. 6*a*–6*e* A perspective view of different embodiments of electrical connections or terminals.

FIGS. 6*a* to 6*e* show variants of the electrical connections 18 and 20. In FIG. 6*a* the electrical connection 18 is formed by a first wall part 181, which is adapted to the contour of the end 101, 102 of the insulator 10.

Figure 6B:
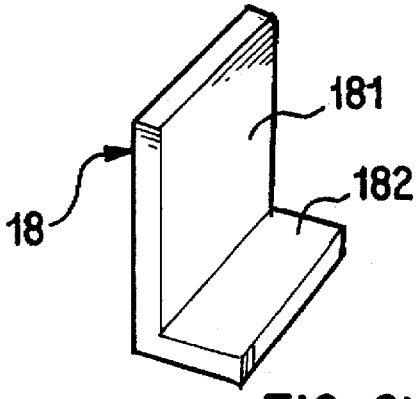

The variant of an electrical connection 18 explained relative to FIG. 4 is shown in FIG. 6*b*. The electrical connection 18 comprises the two wall parts 181, 182 and is cross-sectionally L-shaped.

Figure 6C:
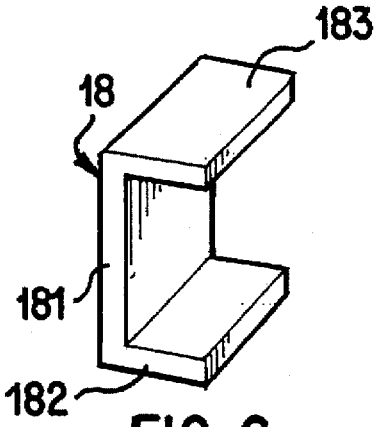
Figure 6D:
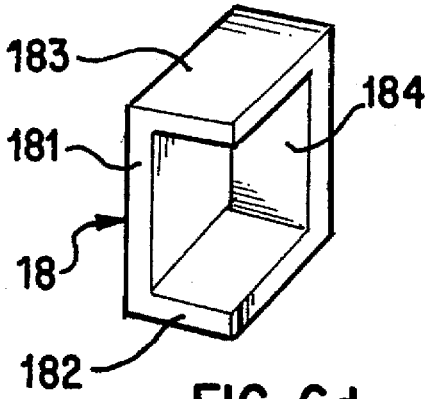

The variant of an electrical connection 18 shown in FIG. 6*c* essentially corresponds to the variant of FIG. 6*b*. On the side opposite to the wall part 182 is fitted a third wall part 183, so that the electrical connection 18 is cross-sectionally U-shaped.

Figure 6E:
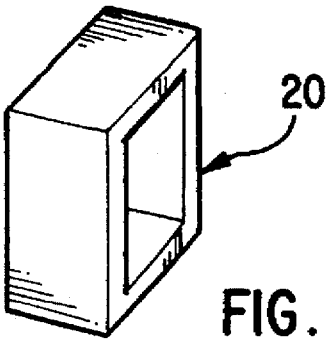

A fourth wall part 184 is according to a further variant of a connection 18 shown in FIG. 6*e* positioned laterally of the three wall parts 181 to 183.

FIG. 6*e* shows the cap 20 formed from five wall parts forming a parallelepiped.

The electrical connections 18 and 20 are fixed exclusively by the solder coating 16 to the insulator 10. Such a construction is made possible by the metal coating 13 applied to the end faces 101, 102 of the insulator 10, because now there is a firm connection between the solder coating 16, via the metal coating 11 and the insulator 10 able to absorb much higher forces than e.g. conventional fuses, where the solder acts directly on the insulator. As a result of the alloying-resistant metallization the preferred, simple embodiments of fuses according to FIGS. 2, 4, 5 and 6*a* to 6*e* are made possible.

Figure 7:
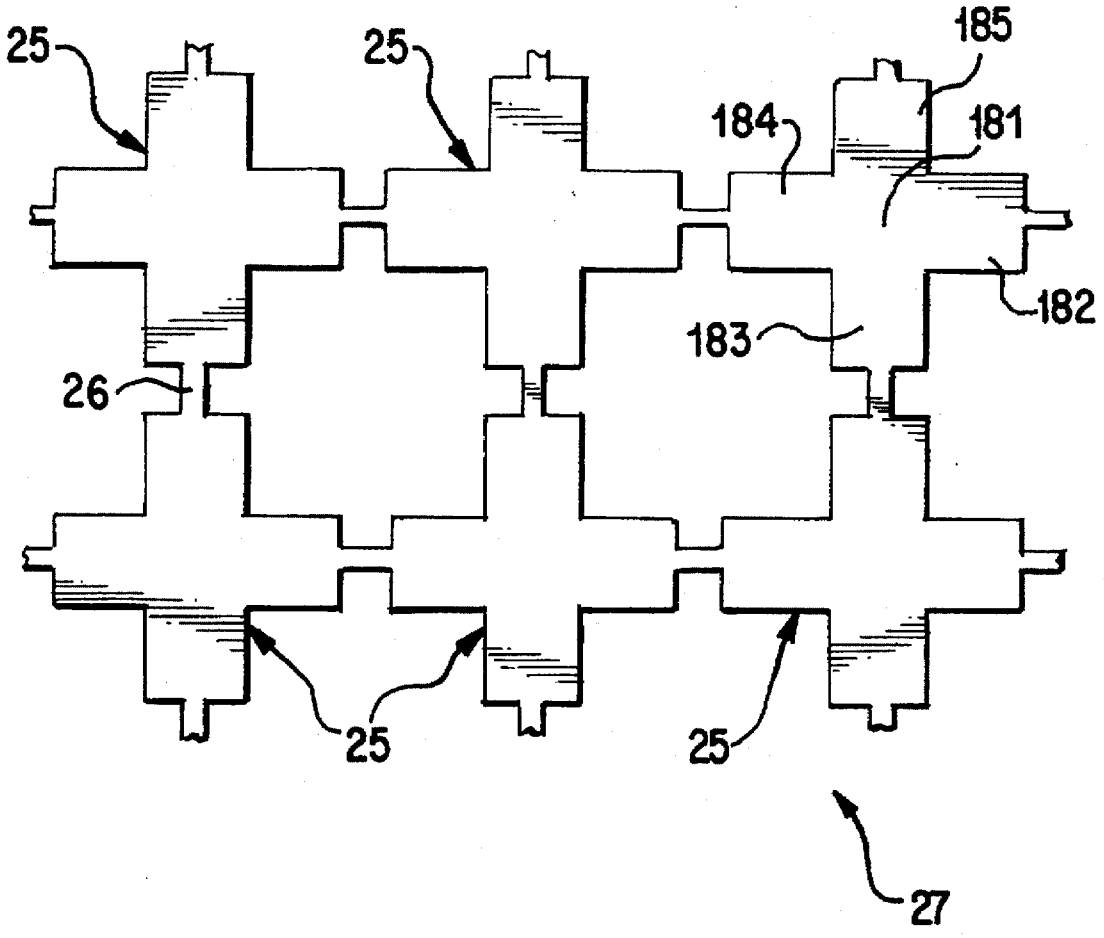
FIG. 7 A plan view of a multiple blank for use in the production of fuses according to an embodiment of the invention.
Figure 7A:
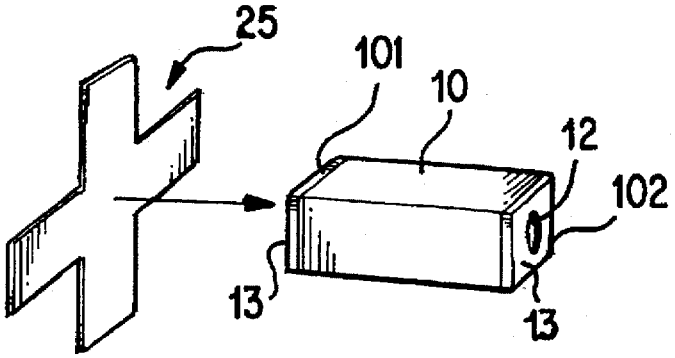
FIGS. 7*a*–7*c* Several perspective views of a stepwise manufacture of the connections on the insulator of a fuse according to an embodiment of the invention.
Figure 7B:
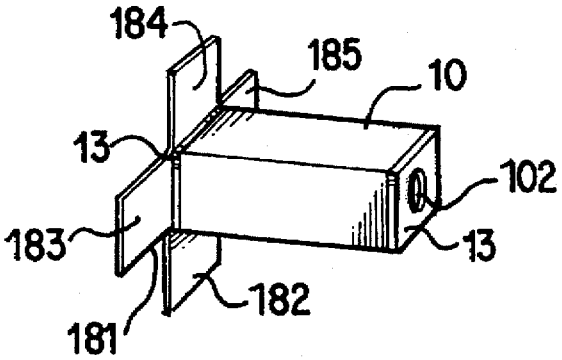
Figure 7C:
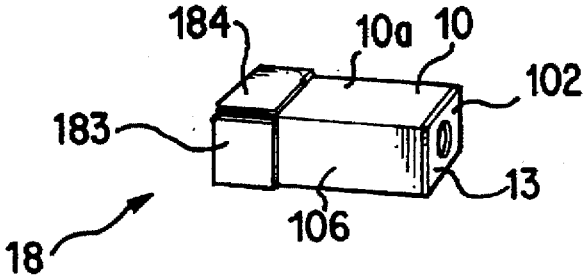

FIG. 7, in conjunction with FIGS. 7*a*–7*c*, illustrate a simple production possibility for producing connections 18 on the ends 101, 102 of fuse insulators 10. In a sheet metal foil material multiple blank 27 intended for the production of the connections 18, whose subsequent wall parts 181 to 185 of the connections 18 are already provided in the form of cruciform sheet metal foil parts 25 and are interconnected by material bridges 26.

By means of a not shown device, e.g. a perforated rubber plate, insulators 10 arranged in mutually perpendicular rows are placed and soldered with their free, metallized (metal coating 13) end faces 101 centrally on the cruciform sheet metal foil parts 25 of the multiple blank 27, accompanied by the interposing of a not shown solder coating, so that the frontal wall parts 181 of the connections 18 are fixed to the insulators 10. After cutting off the material bridges 26 the laterally projecting wall parts 182 to 185 are bent up and applied to the corresponding side walls 10*a*, 10*b* of the insulator 10 and optionally soldered, so that a connection 18 is formed in the form of a rectangular cap with numerous connection possibilities.

The same process steps are performed for forming corresponding connections 18 of the other end face 102.

Figure 8:
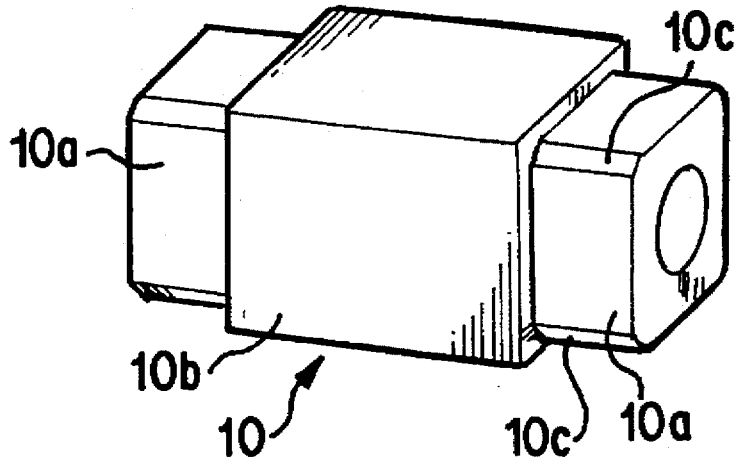
FIG. 8 A perspective view of an insulator with a cross-sectionally square casing part and offset end portions on both sides, which have a substantially square cross-section.
Figure 9:
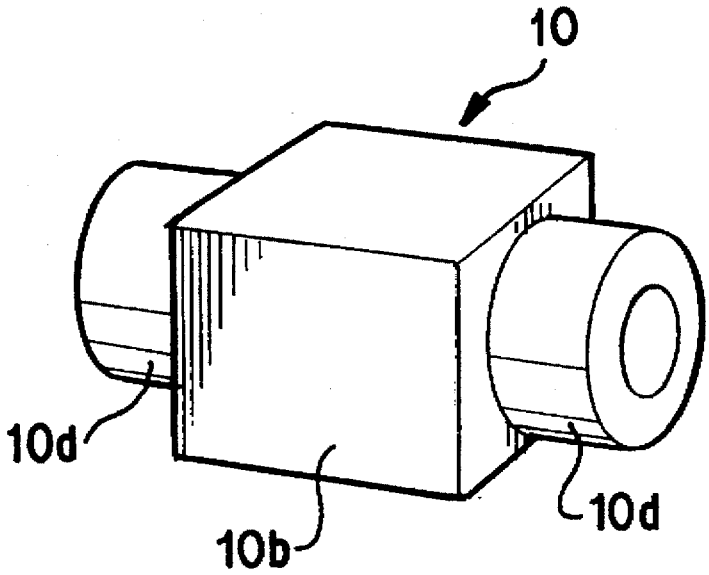
FIG. 9 A perspective view of an alternative embodiment to FIG. 8 with cylindrical end portions on a substantially parallelepipedic casing of the insulator.
Figure 10:
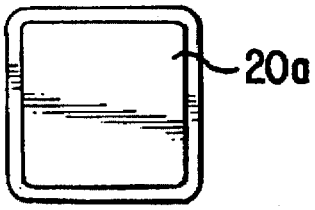
FIG. 10 A plan view of a metal cap having a square cross-section serving as a terminal, e.g. for the embodiment according to FIG. 8.

The embodiments according to FIGS. 8 and 9 showing stepped insulators 10 have particular significance in conjunction with differently shaped caps 20*a*, 21*a*, 23*a* and 25*a* made from metal serving as electrical connections and which can be engaged on and fixed to offset end portions 10*a* or 10*d* of the insulator 10 shown in FIGS. 8 and 9.

The metal coatings, referred to in conjunction with the previously described embodiments, for the purpose of metallizing solder-receiving surfaces, particularly the ceramic material insulator parts are also unrestrictedly used, when necessary, in the embodiments according to FIGS. 8 to 21, in order to ensure a reliable fixing of the caps 20*a*, 21*a*, 23*a* and 25*a* to the end portions 10*a*, 10*d* of the insulator 10. Therefore, in conjunction with the embodiments of FIGS. 8 to 21, the comments already made in connection with the metallization and the solder coating will not be repeated.

In the embodiment according to FIG. 8 the end portions 10*a* have a substantially square and in particular constant cross-section. So that the caps can be easily slid on, the edges 10*c* of the end portions 10*a* are chamfered.

Whereas in the embodiment according to FIG. 8 to a cross-sectionally constant, square casing 10*b* are connected in each case cross-sectionally constant, square end portions 10*a*, the end portions 10*d* in the embodiment according to FIG. 9 are hollow cylindrical and are also stepped with respect to the cross-sectionally constant, square casing 10*b*.

With respect to the dimensioning of the caps according to FIGS. 10 to 21, it is important that they only slightly project with respect to the insulator casing 10*b*. The stepping between the casing 10*b* and the end portions 10*a* or 10*d* in each case forms a clearly defined stop when mounting the caps 20*a* to 25*a* on the end portions 10*a* or 10*b*.

Figure 11:
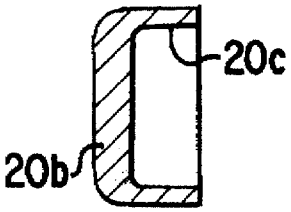
FIG. 11 A cross-sectional view for FIG. 10 of a cap with a reinforced bottom.
Figure 12:
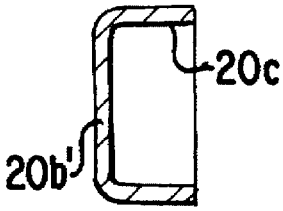
FIG. 12 A further cross-sectional view for FIG. 10, but with the same thickness of the bottom and the wall.
Figure 13:
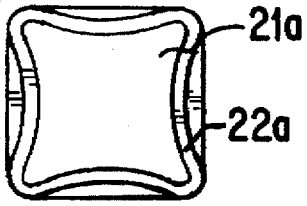
FIG. 13 A plan view of a metal cap with curved portions for obtaining a cap press fit.
Figure 14:
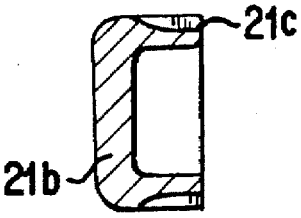
FIGS. 14 & 15 Cross-sectional views of different developments of the cap of FIG. 13.
Figure 15:
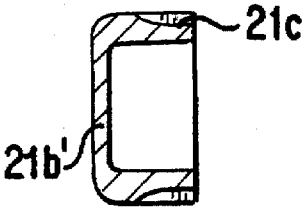
Figure 16:
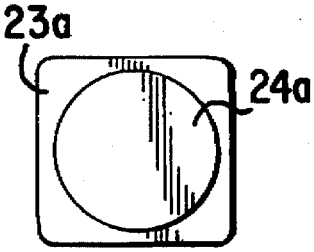
FIG. 16 Another embodiment of a metal cap, externally having a square and internally a cylindrical cross-section.
Figure 17:
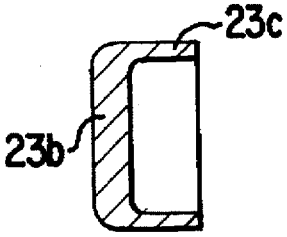
FIGS. 17 & 18 Cross-sectional views to FIG. 16 with varyingly thick cap bottoms.
Figure 18:
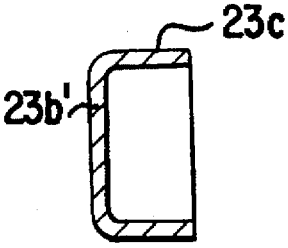
Figure 19:
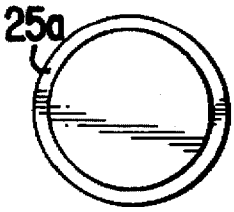
FIG. 19 A plan view of a metal cap with a cylindrical cross-section.
Figure 20:
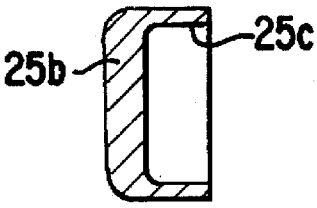
FIGS. 20 & 21 Cross-sectional views to FIG. 19 of caps with varyingly thick bottoms.
Figure 21:
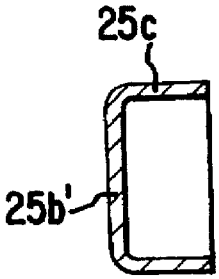

As can be gathered from FIGS. 11 and 12, as well as FIGS. 14 and 15, the bottom 20*b* (FIG. 11) is thicker than the wall 20*c* associated with the cap 20*a*. However, it is also possible to make the bottom 20*b*' just as thick as the wall 20*c* (FIG. 12). The same applies with respect to the thicker bottom 21*b* of the cap 21*a* with respect to the wall 21*c* (FIG. 14) and also in this embodiment the bottom 21*b* can be of exactly the same thickness as the wall 21*c*. However, the special nature of the embodiment according to FIGS. 13 to 15 is that the wall 21*c* has arcuately inwardly curved portions 22*a*, as shown in the drawings. This embodiment leads to a press fit, if the cap 21*a* is shoved onto the corresponding end portion 10*a*.

Varyingly thick bottoms 23*b* compared with 23*b*' or 25*b* compared with 25*b*' with respect to the associated walls 23*c* or 25*c* are also shown in further cap embodiments according to FIGS. 16 to 21. When using a cap 23*a* with an externally square and internally (24*a*) cylindrical cross-section, even in the case of a cylindrical construction of the end portions 10*d*, as in the embodiment according to FIG. 9, it is ensured that following the manufacture of the fuse, an externally uniform profile is obtained. However, when using the shape of the cap 25*a* according to FIG. 19, it is accepted that the free steps at the corners of the end faces of the casing 10*b* of the insulator 10 will occur in the construction according to FIG. 9, but this also leads to cylindrical connections for e.g. corresponding mounting supports.

We claim:

1. Fuse with an insulator with generally flat face ends and a circumferential area, through which extends from one face end to the opposite face end a cavity, a metal coating covering the face ends and the circumferential area adjacent to the face ends, a fuse element passing through the cavity and whose ends are each conductively connected to electrical connections and laying on corresponding portions of the metal coating, a solder coating covering the ends of the fuse element and portions of the metal coating not covered by these ends, characterized in that the ends of the fuse element are embedded in the solder coating, the solder coating is closing the cavity at the face ends of the insulator and extends into the cavity in the form of a projection, the ends of the insulator have a cross-sectionally square or rectangular shape, and the metal coating on both face ends of the insulator extends into the cavity, wherein the electrical connections (18, 20) are exclusively fixed by means of the solder coating (16) to the metallized end portions of the insulator (10), at least one electrical connection (18) is formed by a first wall part (181) oriented parallel to the end (101, 102) of the insulator, and on the first wall part (181) is placed a second wall part (182), which runs substantially perpendicular to the former, so that the electrical connection (18) is cross-sectionally L-shaped.

2. Fuse according to claim 1, characterized by cross-sectionally through, square, rectangular or circular end portions.

3. Fuse according to claim 2 or 1, characterized in that the insulator (10) is made from ceramic material particularly alumina ceramic, magnesium silicate ceramic or glass.

4. Fuse according to claim 1 characterized in that the metal coating (13) is of alloying-resistant silver, silver palladium, silver platinum or silver palladium platinum.

5. Fuse according to claim 1 characterized in that the metal coating (13) is produced by application and firing on a metal paste.

6. Fuse according to claim 1, characterized in that the first wall part (181) is adapted to the contour of the end (101, 102).

7. Fuse according to claim 1, characterized in that further wall parts (183, 184, 185) are placed on the first wall part (181) and are substantially perpendicular thereto.

8. Fuse according to claim 1, characterized in that from the wall part (181) of the connection (18) fixed by soldering to the metallized end (101, 102) of the insulator (10) is bent up or down at least one laterally projecting wall part (182) and is applied flat to the corresponding side wall (10*a*, 10*b*) of the insulator (10).

9. Fuse according to claim 8, characterized in that the wall parts (182, 181, 183, 184, 185) to be soldered and bent are initially connected in a multiple blank (27), on which can be placed by means of a device a plurality of insulators (10) in such a way that the exposed, metallized end faces (101, 102), accompanied by the interposing of solder coatings (16), can be engaged on the associated wall parts (181) and soldered thereto, accompanied by the subsequent upward bending and application of the further wall parts (182, 183, 184, 185) to the corresponding sides (10*a*, 10*b*) of the insulator (10).

10. Fuse according to claim 9, characterized in that the multiple blank (27) comprises interconnected, cruciform sheet metal foil parts (25) from which the wall parts (181 to 185) are formed.

11. Fuse according to claim 1, characterized in that at least one solder coating (16) on one end (101, 102) of the insulator (10) and forms an electrical connection.

12. Fuse according to claim 1, characterized by a construction as a SM component.

13. Fuse with an insulater with generally flat face ends and a circumferential area, through which extends from one face end to the opposite face end a cavity, a metal coating covering the face ends and the circumferential area adjacent to the face ends, a fuse element passing through the cavity and whose ends are each conductively connected to electrical connections and laying on corresponding portions of the metal coating, a solder coating covering the ends of the fuse element and portions of the metal coating not covered by these ends, characterized in that the ends of the fuse element are embedded in the solder coating, the solder coating is closing the cavity at the face ends of the insulator and extends into the cavity in the form of a projection, the ends of the insulator have a cross-sectionally square or rectangular shape, and the metal coating on both face ends of the insulator extends into the cavity, wherein the electrical connections (18, 20) are exclusively fixed by means of the solder coating (16) to the metallized end portions of the insulator (10), and at least one electrical connection (20) is constructed as a cap whose shape corresponds to the associated end portion and which is shoved over an end portion of the insulator (10).

14. Fuse according to claim 13, characterized in that the bottom (20*b*, 21*b*, 23*b*, 25*b*) of the cap (20*a*, 21*a*, 23*a*, 25*a*) is thicker than the cap wall (20*c*, 21*c*, 23*c*, 25*c*).

15. Fuse according to claim 13, characterized in that the wall (21*c*) of the cap (21*a*) with respect to the bottom (21*b* or 21*b*') has at least one inwardly curved portion (22*a*), but preferably symmetrically distributed curved portions (22*a*), for an engagement of the cap (21*a*) on the corresponding end portion (10*a*), accompanied by cap press fit.

* * * * *